United States Patent [19]

Lieb et al.

[11] Patent Number: 4,864,973

[45] Date of Patent: Sep. 12, 1989

[54] SPIRAL TO VERTICAL FURNACE TUBE TRANSITION

[75] Inventors: Carl Lieb, Norton; Jerry L. Mullinax, Uniontown, both of Ohio

[73] Assignee: The Babcock & Wilcox Company, New Orleans, La.

[21] Appl. No.: 858,856

[22] Filed: Apr. 30, 1986

Related U.S. Application Data

[63] Continuation of Ser. No. 688,945, Jan. 4, 1985, abandoned.

[51] Int. Cl.[4] ..... F28B 9/00

[52] U.S. Cl. ..... 122/510; 122/6 A

[58] Field of Search ..... 122/510, 512, DIG. 4, 122/6 A, 235 A, 235 K

[56] References Cited

U.S. PATENT DOCUMENTS

| | | | |
|---|---|---|---|
| 3,396,707 | 8/1968 | Bagley et al. | 122/235 A |
| 4,063,534 | 12/1977 | Krol | 122/510 |
| 4,175,519 | 11/1979 | Pratt et al. | 122/510 |
| 4,290,388 | 9/1981 | Ruhe et al. | 122/510 |
| 4,307,777 | 12/1981 | Chwyla | 122/510 |
| 4,347,810 | 9/1982 | Rees | 122/510 |
| 4,418,652 | 12/1983 | Rees | 122/235 K |
| 4,480,594 | 11/1984 | Sullivan et al. | 122/510 |

*Primary Examiner*—Henry C. Yuen

*Attorney, Agent, or Firm*—Robert J. Edwards

[57] ABSTRACT

A furnace for a once-through steam generator comprising a lower section of inclined tubes and upper section of vertical tubes and a support system and tube arrangement at a transition zone intermediate the sections.

4 Claims, 6 Drawing Sheets

SPIRAL TO VERTICAL FURNACE TUBE TRANSITION

This application is a continuation of application Ser. No. 688,945 filed Jan. 4, 1985, abandoned.

BACKGROUND OF THE INVENTION

1. Field of the Invention

This invention applies to furnace tube wall enclosures defining the periphery of the furnace, the lower portion of the walls consisting of spiral-wound inclined tubes and the upper portion consisting of load-carrying vertical tubes which support the lower portion and, more particularly, relates to the transition from spiral to vertical circuitry. Hereinafter, "inclined tubes" will define the spiral-wound tubes in the lower furnace and "vertical tubes" the load-carrying vertical tubes in the upper portion of the furnace. The invention concept applies to subcritical or supercritical once-through steam generators having all-welded membrane furnace walls.

A major problem in the design of such units is the support system and in the tube arrangement in the transition zone from inclined to vertical tubes. The inclined tubes are sloped up to about 30 degrees from horizontal and spiral up the furnace making several turns. The inclined tubes terminate in a header below the furnace arch for transition to vertical tubes in the upper portion of the furnace. Because a near-horizontally oriented tube can usually carry only a limited amount of static load in the vertical direction, the inclined tube portion of the furnace requires an external support system to transfer load to the vertical tubes.

2. Description of the Prior Art

Relevant prior art includes Kolling, U.S. Pat. No. 3,027,882, which discloses vertical support bars connecting inclined tubes to vertical tubes in a furnace, Bagley et al, U.S. Pat. No. 3,400,689, which discloses vertical tension members connected at their lower ends to the furnace walls and supported by springs at their upper ends, and Gorzegno et al, U.S. Pat. No. 4,116,168, which discloses inclined tubes in an intermediate furnace section connected by bifurcates to upper and lower vertical tube portions of the furnace.

SUMMARY OF THE INVENTION

The invention relates to a tube wall enclosure for the furnace of a oncethrough steam generator comprising a lower section of inclined tubes fed in parallel from a ring header at the bottom of the furnace. The inclined tubes spiral upwards at an angle of up to about 30 degrees from horizontal, making at least one full turn around the furnace, and terminating in vertical manifold headers located at spaced distances around the furnace. The upper furnace section consists of load-carrying vertical tubes in fluid communication with the lower section at a transition zone. Vertical and inclined tubes are spaced from one another and weldably interconnected by membranes forming a gas-tight enclosure. Vertical external support straps are flush mounted and weldably attached to the tubes of the lower furnace section for transfer of static load to the tubes of the upper furnace section. The tubes of the upper section overlap the tubes of the lower section to eliminate eccentric loading and to simplify the tube arrangement at the transition zone.

The various features of novelty which characterize the invention are pointed out with particularity in the claims annexed to and forming a part of this specification. For a better understanding of the invention, its advantages and specific objectives obtained by its use, reference is directed to the accompanying drawings and descriptive matter in which a preferred embodiment of the invention is illustrated and explained.

DETAILED DESCRIPTION

Figure 1:
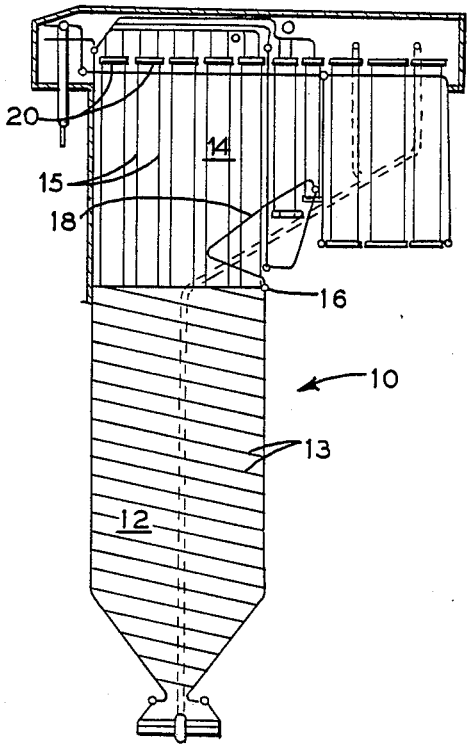
FIG. 1 is a schematic sectional side view of a once-through steam generator having inclined and vertical furnace tube sections.

Referring to FIG. 1, a schematic sectional side view of a once-through steam generator 10 is shown having a lower furnace section 12 of inclined tubes 13 which are membraned and spiral upwards to a transition zone 16 below the furnace arch 18. From the transition zone 16, the inclined tubes 13 are in fluid communication with upper furnace section 14 composed of vertical membraned tubes 15 in panels for upward flow to outlet headers 20. Inclined and vertical tubes 13 and 15 are shown in greater detail in subsequent drawings.

Figure 2:
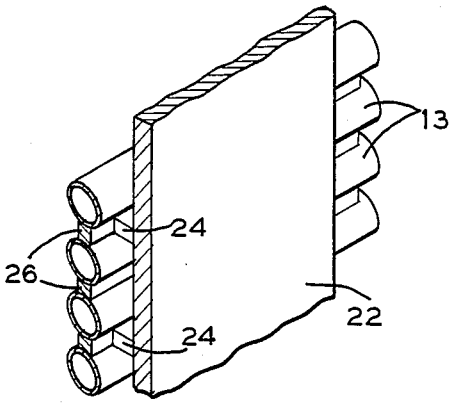
FIG. 2 is an isometric view of a portion of the inclined tube lower furnace walls showing an external support strap with extending bars.

FIG. 2 illustrates the method of support of inclined tubes 13 in the lower furnace section 12 and one of several support straps 22 with bars 24 which extend the full width of support strap 22 and weldably interconnect the inclined tube membranes 26 with support strap 22. The support straps 22 are mounted flush with the outside surface of inclined tubes 13 and are spaced at suitable distances around the periphery of the lower furnace section 12 to accommodate the static load of the inclined tubes 13 and for transfer of load to vertical tubes 15 in upper furnace section 14. The upper ends (shown in FIGS. 5 and 8) of support straps 22 are flared to a greater width for transfer of load to a greater number of vertical tubes 15 as will be later described.

Figure 3A:
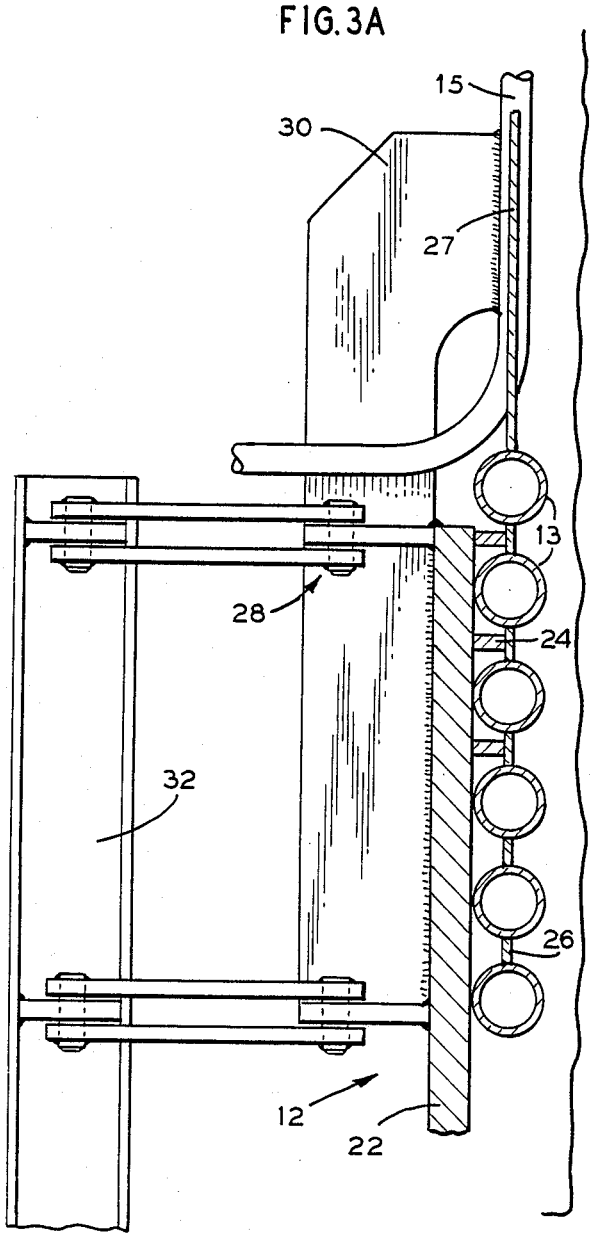
FIG. 3A is a sectional view of the prior art support at the transition zone.

FIG. 3A shows an existing design of the transition zone and the load trnasfer from support straps 22 to vertical tubes 15 by means of finger plates 30. As indicated, the longitudinal centerlines of vertical tubes 15 are in line with the centerlines of inclined tubes 13. Since the static load of lower furnace section 12 is carried by support straps 22, a turning moment is produced due to eccentricity. To eliminate this moment, a complex, expensive pinned linkage system 28 is employed between support straps 22 and vertical buckstays 32. Also shown are the inclined and vertical tube membranes 26 and 27, respectively, and bars 24 interconnecting the membranes 26 with support strap 22.

Figure 3B:
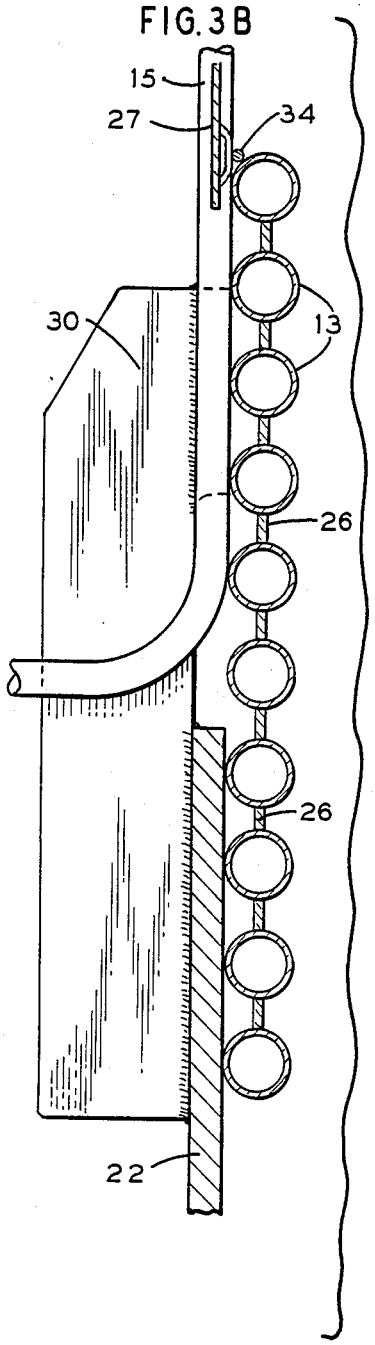
FIG. 3B is a sectional view of the support in accordance with the invention.

The improved design is shown in FIG. 3B. Vertical tubes 15 are located to overlap the inclined tubes 13. The longitudinal centerlines of vertical tubes 15 are approximately in line with the centerlines of the support straps 22 thereby eliminating the moment due to eccentric loading while also eliminating the vertical buckstays 32 and linkage system 28 associated with the prior art design shown in FIG. 3A. A seal 34 between the uppermost tubes 13 and vertical tube membranes 27 insures the gas tight integrity of the furnace enclosure. Other advantages of this improved design will be apparent as described in subsequent drawings. Also shown is one of the finger plates 30 and the inclined tube membranes 26.

Figure 4:
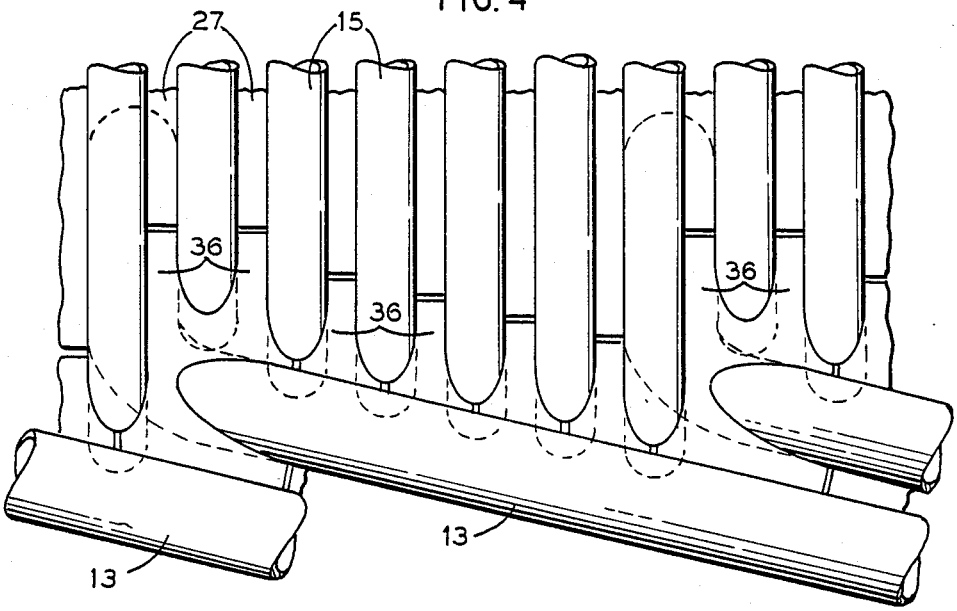
FIG. 4 is a view from the furnace side showing the prior art tube arrangement and closure at the transition zone.

FIG. 4 is a view from the furnace side showing the closure at the transition zone of the existing design. Inclined tubes 13 leave the furnace at the same horizontal plane and terminate in a horizontal outlet header, not shown, exterior to the furnace enclosure. Since the longitudinal centerlines of vertical tubes 15 are in line with the inclined tube centerlines, vertical tubes 15 leave the furnace at varying elevations, following the slope of inclined tubes 13. Accordingly, vertical tube membranes 27 also terminate at varying elevations. To provide a gas-tight furnace, closure plates 36 of various shapes are required to seal the areas between vertical membrane terminations and the uppermost inclined tubes 13. As is evident from FIG. 4 this is an expensive design requiring much hand fitting and welding in the field during erection. In addition, vertical tubes 15 require individual hand bending because of the varying elevations where they leave the furnace and terminate in an external header, not shown.

Figure 7:
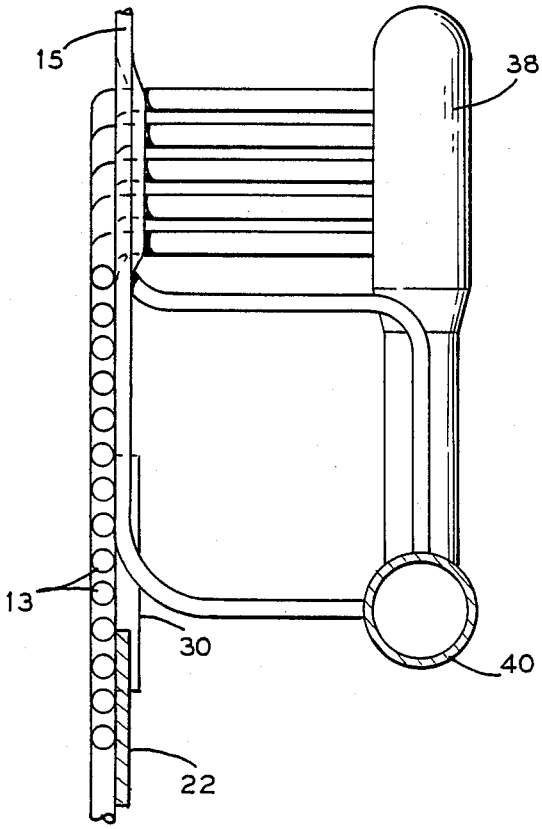
FIG. 7 is a sectional view taken along the line 7'7 of FIG. 5.
Figure 5:
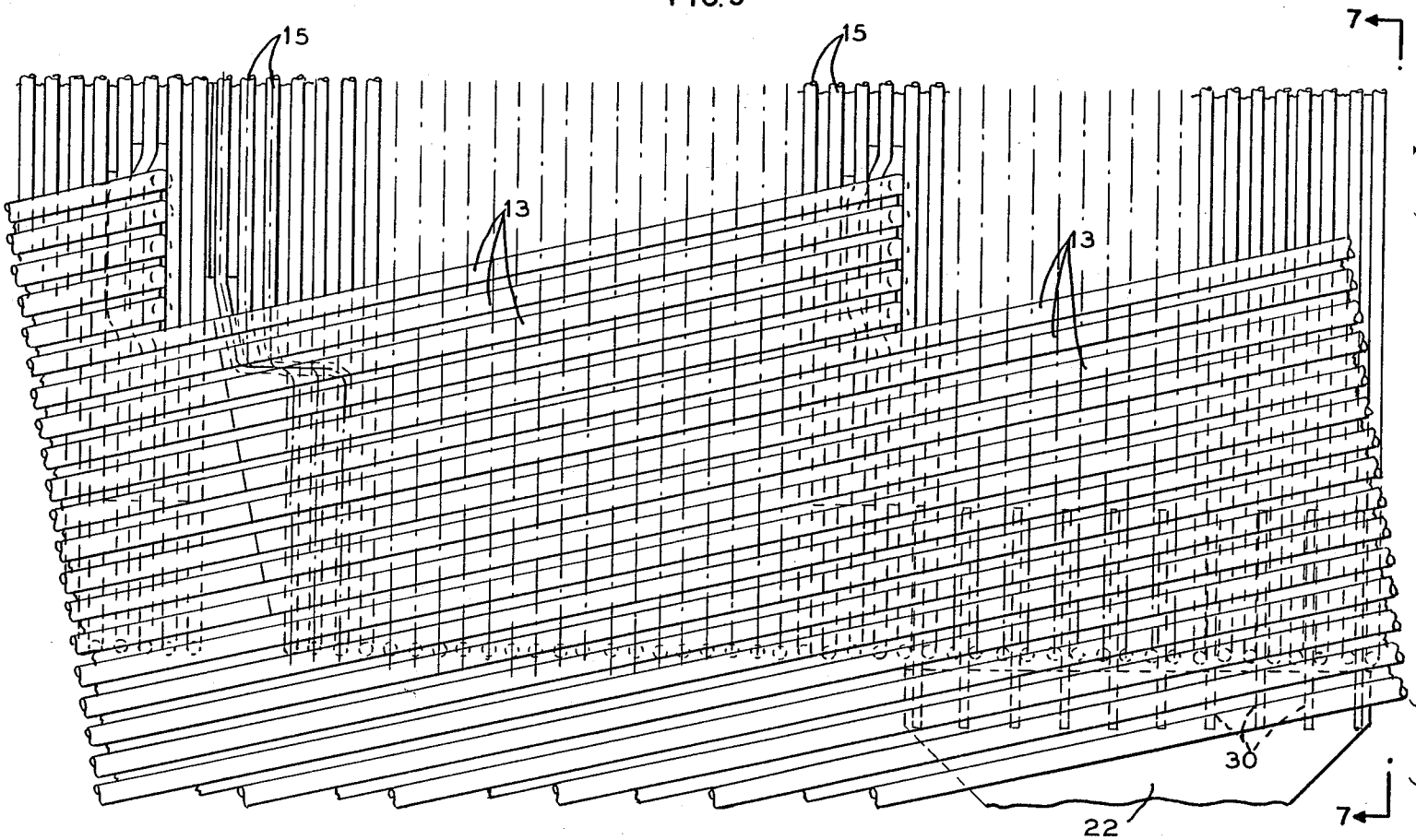
FIG. 5 is a view from the furnace side showing the tube arrangement at the transition zone in accordance with the invention.
Figure 6:
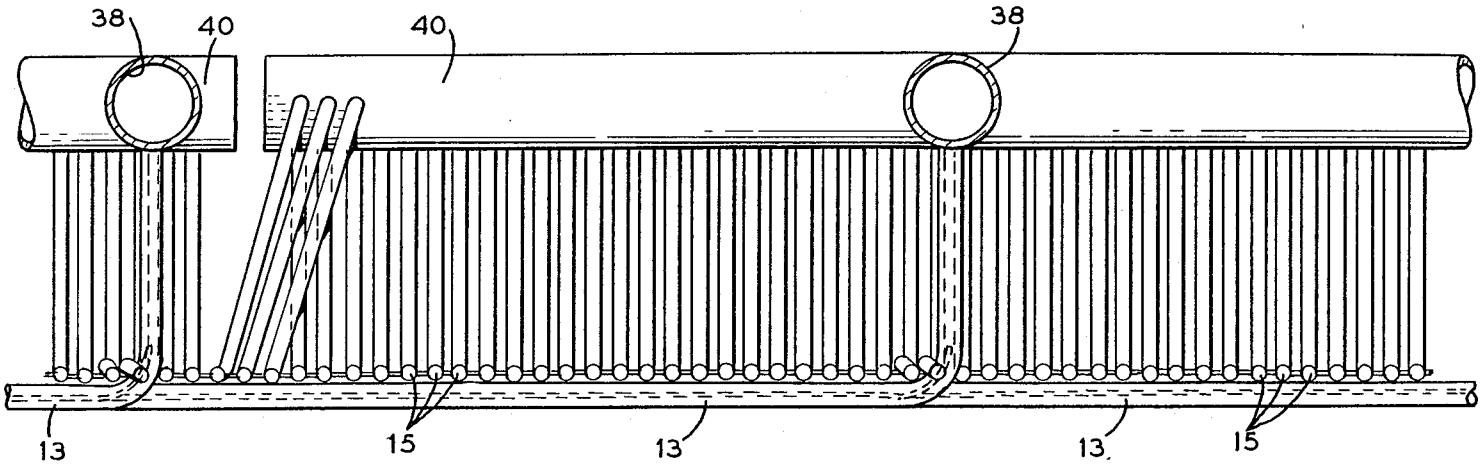
FIG. 6 is a sectional plan view of FIG. 5.

In contrast, FIGS. 5, 6 and 7 illustrate in detail the new design and its advantages. In the embodiment shown, inclined tubes 13 leave the furnace in vertical groups of five, although a greater or lesser number of tubes 13 may be grouped. The groups penetrate to outside the furnace through spaces between vertical tubes 15 and terminate in outlet vertical manifolds 38 spaced at suitable distances around the furnace. Manifolds 38 are connected to horizontal inlet headers 40 for fluid flow communication. Flow is then upward in vertical tubes 15 to outlet headers 20 (shown in FIG. 1). Vertical tubes 15 overlap inclined tubes 13 and bend outwardly in a horizontal plane below the inclined tube exit groups, terminating in horizontal headers 40. Expensive closure plates are eliminated and field hand welding is reduced. Vertical tubes 15 are machine pack-bent in panels eliminating individual hand bending of previous designs. Also shown are finger plates 30 and support straps 22.

Figure 8:
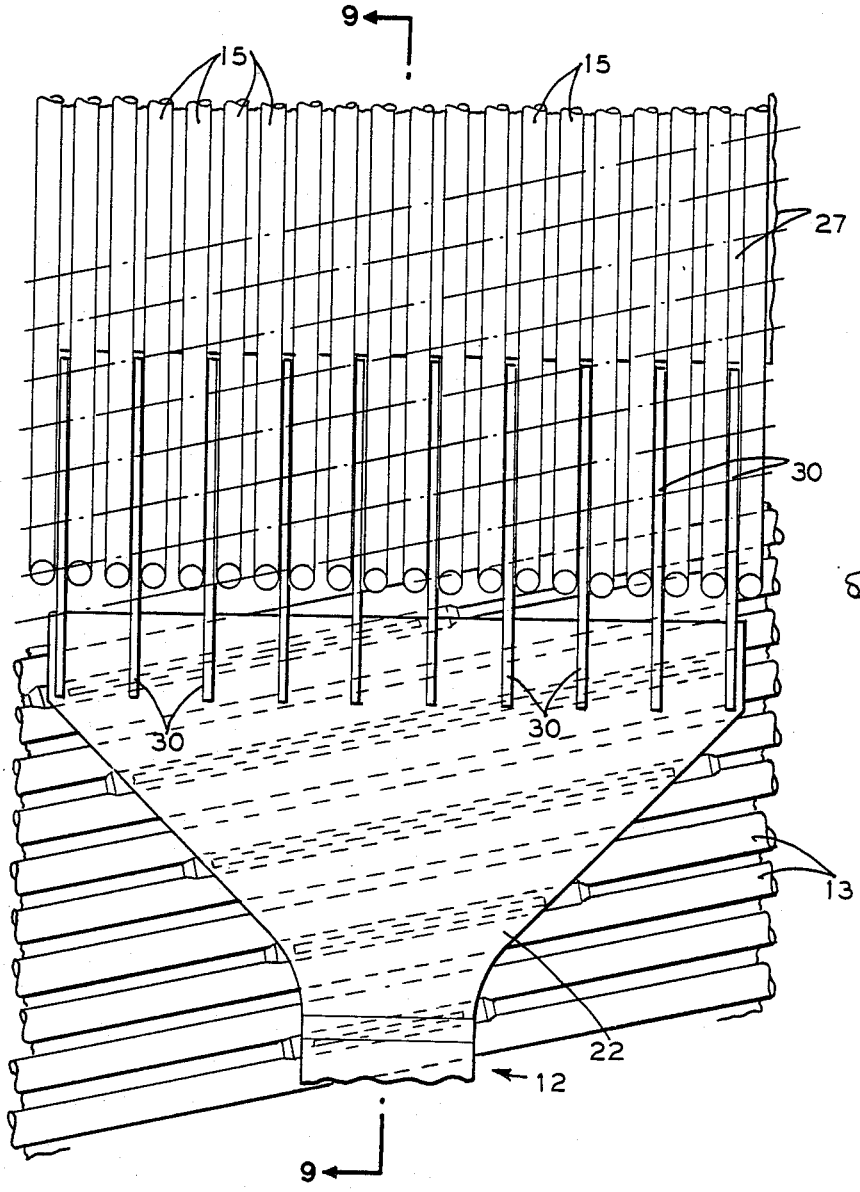
FIG. 8 is an external view showing the support system in greater detail.
Figure 9:
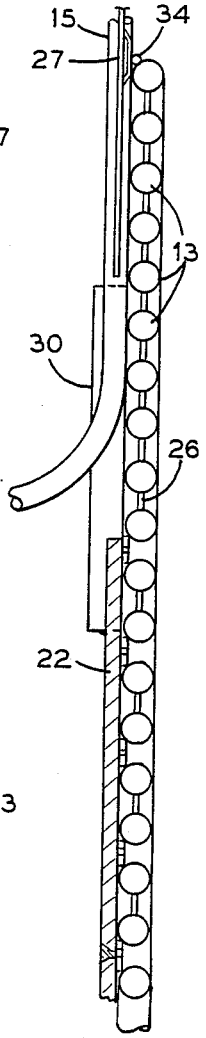
FIG. 9 is a sectional elevation taken along the line 9—9 of FIG. 8.

FIGS. 8 and 9 are similar to FIGS. 5 and 7 but are viewed from outside the furnace. Shown is the flared end of one support strap 22 having ten vertical finger plates 30 welded thereto and the upper ends of the finger plates welded to adjacent pairs of vertical tubes 15 for load transference. A greater or lesser number of finger plates 30 may be employed, depending on the magnitude of the static load of lower furnace section 12 and the width of the flared upper ends of support straps 22. Also shown are inclined tubes 13, inclined and vertical tube membranes 26 and 27, respectively.

The foregoing description has been directed to a particular preferred embodiment of the present invention for purposes of explanation and illustration. It should be recognized, however, by those skilled in the art that modifications and changes in the invention may be made without departing from the scope and spirit of the invention. It is therefore intended that the following claims cover all equivalent modifications and variations as fall within the scope of the invention as defined by the claims.

The embodiments of the invention in which an exclusive property or privilege is claimed are defined as follows:

1. A furnace tube wall enclosure defining a furnace for a once-through steam generator comprising a lower furnace section of spaced inclined tubes which spiral upward to a transition zone, the inclined tubes being rigidly united by membranes disposed in the intertube spaces, an upper furnace section extending above the lower furnace section, the upper furnace section including load-carrying vertical tubes in fluid communication with the inclined tubes, the vertical tubes having lower portions disposed horizontally alongside of the upper portions of the inclined tubes, means for connecting said lower portions of the vertical tubes to said upper portions of the inclined tubes, said connecting means including vertical external support straps spaced peripherally about the lower furnace section and weldably connected to the membranes uniting the inclined tubes below the lower portion of the vertical tubes, and a plurality of securing plates secured to each of the straps and weldably connected to the vertical tubes alongside of the upper portion of the inclined tubes, wherein the support straps are mounted flush with the outside surface of the inclined tubes, the support straps including bars weldably interconnecting the membranes to the support straps, and wherein the vertical tubes have longitudinal centerlines approximately vertically in line with the centerlines of the support straps.

2. A furnace tube wall enclosure defining a furnace for a once-through steam generator comprising a lower furnace section of spaced inclined tubes which spiral upward to a transition zone, the inclined tubes being rigidly united by membranes disposed in the intertube spaces, an upper furance section extending above the lower furnace section, the upper furnace section including load-carrying vertical tubes in fluid communication with the inclined tubes, the vertical tubes having lower portions disposed horizontally alongside of the upper portions of the inclined tubes, means for connecting said lower portions of the vertical tubes to said upper portions of the inclined tubes, said connecting means including vertical external support straps spaced peripherally about the lower furnace section and weldably connected to the membranes uniting the inclined tubes below the lower portion of the vertical tubes, and a plurality of securing plates secured to each of the straps and weldably connected to the vertical tubes alongside of the upper portion of the inclined tubes and further comprising vertical manifolds spaced around the furnace and wherein the inclined tubes extend in vertically aligned groups between vertical tubes alongside of the upper portions of the inclined tubes and terminate in the vertical manifolds.

3. The furnace tube wall enclosure as recited in claim 2 further comprising horizontal headers in flow communication with the vertical manifolds and wherein the vertical tubes extend outwardly of the furnace in a horizontal plane below the vertically aligned groups of inclined tubes and terminate in the horizontal headers.

4. The furnace tube wall enclosure as recited in claim 3 wherein each of the vertically aligned groups comprises five inclined tubes.

* * * * *